United States Patent [19]

Roth et al.

[11] 4,446,984

[45] May 8, 1984

[54] PUSH-IN CLOSURE

[75] Inventors: Donald J. Roth, Westport, Conn.; John Walter, Evergreen Park, Ill.; Charles S. Kubis, Weston, Conn.

[73] Assignee: Continental Packaging Company, Inc., Stamford, Conn.

[21] Appl. No.: 497,309

[22] Filed: May 23, 1983

[51] Int. Cl.[3] ..... B65D 17/32

[52] U.S. Cl. ..... 220/268; 220/306; 220/307; 220/367; 220/271

[58] Field of Search ..... 220/266, 268, 270, 271, 220/276, 306, 307, 367; 222/541

[56] References Cited

U.S. PATENT DOCUMENTS 4,344,545 8/1982 Aschberger et al. ..... 220/307

4,350,260 9/1982 Prueher ..... 220/268

*Primary Examiner*—George T. Hall

*Attorney, Agent, or Firm*—Charles E. Brown

[57] ABSTRACT

This relates to a closure for containers, particularly containers such as containers for beverages and the like which are packaged under pressure. The closure includes an outer retaining ring portion and an inner sealing plug portion which are preferably initially molded as a unitary product, but wherein the sealing plug portion is connected to the ring portion primarily by a rupturable connecting line. The retaining ring portion is interlocked with an extreme end of the neck finish of a container and the sealing plug portion is interlocked in sealing relation with an internal shoulder of the container neck finish, which shoulder defines a pour opening. The sealing plug portion is retained in association with the retaining ring portion by a hinge strap which is elongatable under tension. The sealing plug portion is also provided with a vent opening which is normally closed by a vent valve which is held in its closed position by internal pressure and which is movable manually to a vent position. The closure is opened by first depressing the vent valve to open the same and by continuing the pressure thereon to effect rupture and separation of the sealing plug portion from the retaining ring. When the sealing plug portion is pressed into the interior of the container, it wedges within the pour opening and retains its open position. This abstract forms no part of the specification of this application and is not to be construed as limiting the claims of the application.

15 Claims, 6 Drawing Figures

PUSH-IN CLOSURE

This invention relates in general to new and useful improvements in closures, and more particularly to a closure which is preferably formed of a plastic material and which has a snap-in interlock with a container neck finish and wherein the closure has a sealing plug portion which is initially integrally formed with an outer annular retaining ring portion, but wherein the connection between the two portions includes a line of rupture with the exception of a hinge wherein opening of an associated container is effected by pressing in the sealing plug portion.

The closure is particularly adapted for use in conjunction with a container having a liquid packaged therein under internal pressure, with the sealing plug portion being provided with a vent passage which is normally closed by a plug valve which may be axially inwardly depressed to open the vent and relieve internal pressure within the container before the sealing plug portion is pressed inwardly to its open position.

Another feature of the invention is the relative diameters of the sealing plug portion and a locking shoulder which is innermost of the neck finish and defines a pour opening normally closed by the sealing plug portion wherein, when the sealing plug portion is pressed inwardly to a generally out-of-the-way position, it will be frictionally retained in such open position.

Yet another feature of the invention is the formation of a hinge as a strap having elongation properties which permits the axial inward movement of the sealing plug portion. The elongation properties may be enhanced by the provision of transverse weakening lines in the strap or by other mechanically induced elongation means.

With the above and other objects in view that will hereinafter appear, the nature of the invention will be more clearly understood by reference to the following detailed description, the appended claims, and the several views illustrated in the accompanying drawings.

IN THE DRAWINGS

Figure 1:
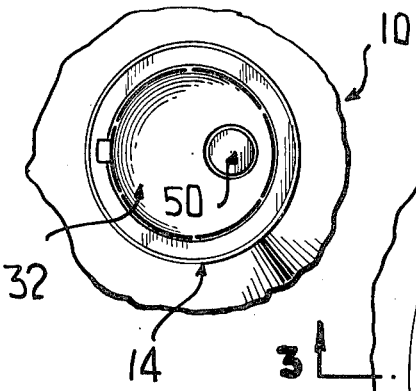
FIG. 1 is a fragmentary top plan view of a container closed by a closure in accordance with this invention.

Referring now to the drawings in detail, it will be seen that there is illustrated a container 10 which is provided with a neck finish, generally identified by the numeral 12, having permanently associated therewith a closure generally identified by the numeral 14.

The container 10 has an upper wall portion 16 from which the neck finish 12 extends. The neck finish 12 includes a generally conical portion 18 which terminates in a radially inwardly and axially inwardly extending flange 20 which generally defines a locking shoulder, the function of which will be described hereinafter. The flange 20 has joined thereto an upwardly and radially outwardly sloping frustoconical mouth portion 22 by means of an intermediate reversely turned part 24. The mouth defining portion 22 terminates in a radially outwardly and downwardly turned curl 26.

In the preferred embodiment, the closure 14 is formed of a suitable injection moldable plastic and includes an outer retaining ring 28 which is formed on the underside thereof with an annular socket 30 having a snap interlock with the curl 26 permanently to retain the closure 14 on the neck finish 12.

The closure 14 also has an inner sealing plug portion generally identified by the numeral 32. The sealing plug portion 32 has a slightly concave end panel 34 and a depending skirt portion 36 which flares slightly downwardly and includes a lower enlargement 38 which defines a locking flange 40. The locking flange 40 is positioned to engage behind the shoulder 20 as well as behind the reversely turned part 24 both to lock the sealing plug portion 32 within the neck finish and to form a seal therewith.

The sealing plug portion 32 is releasably integrally connected to the retaining ring portion 28 along a generally circular weakening line 38 with the exception of a hinge 40 which is in the form of a strap.

The end panel 34 is provided with a vent passage 42 in alignment with the hinge strap 40 and remote therefrom. The vent passage 42 is in part defined by an opening 44 in the end panel and in part by a depending housing 46 having a lower retaining flange 48.

The vent passage 42 is normally closed by means of a vent valve 50 which includes a plug portion 52 having an enlarged intermediate portion 54 of a size tightly to fit within the opening 44. The vent valve 50 further includes a piston-like innermost part 56 which is of a diameter to seat on the underside of the end panel 34 surrounding the vent opening 44 to form a seal therewith.

Figure 3:
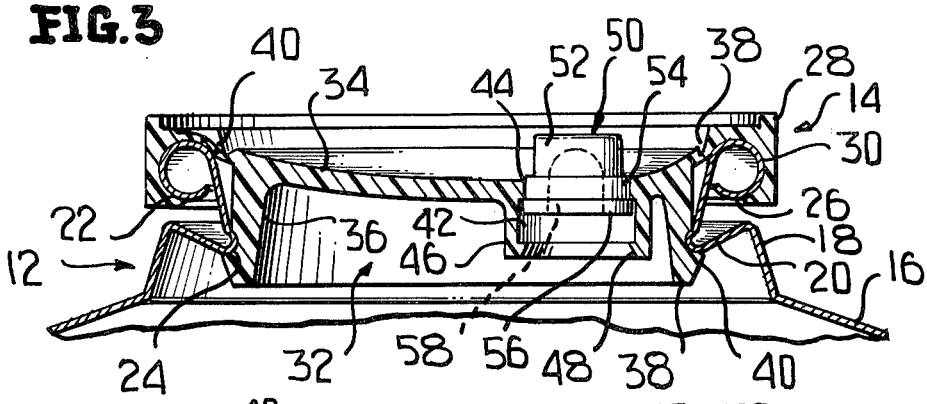
FIG. 3 is a fragmentary vertical sectional view taken generally along the line 3—3 of FIG. 2, and shows a specific cross section of the closure and the mounting thereof on a neck of an associated container.

The vent valve 50 is preferably hollow, having a recess 58 formed therein. Then the underside of the vent valve 50 is subjected to pressure from within the associated container 10, not only does the vent valve assume the position illustrated in FIG. 3, but also it expands radially to form a tight seal with the end panel 34.

Figure 2:
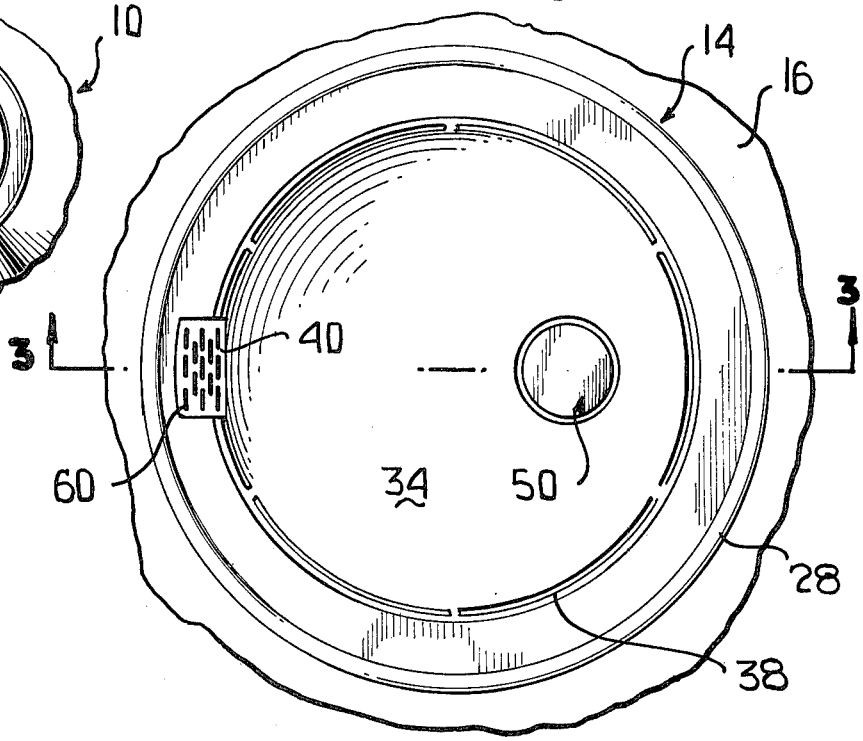
FIG. 2 is an enlarged top plan view showing further the details of the closure of FIG. 1.

The hinge strap 40, depending upon the specific plastic material utilized in the formation of the closure 14, may have considerable elongation properties. On the other hand, it may be desirable to provide mechanical means to facilitate the elongation of the hinge strap 40. With particular reference to FIG. 2, it will be seen that the hinge strap 40 may be provided with series of relief lines 60 extending transversely of the hinge strap 40, but not extending entirely through the thickness of the hinge strap. These relief lines 60, when the hinge strap 40 is tensioned, serve to permit an opening up of the hinge strap and an elongation thereof such as occurs when a sheet of metal is slit and then tensioned in a direction transversely of the slits in the formation of expanded metal.

Figure 4:
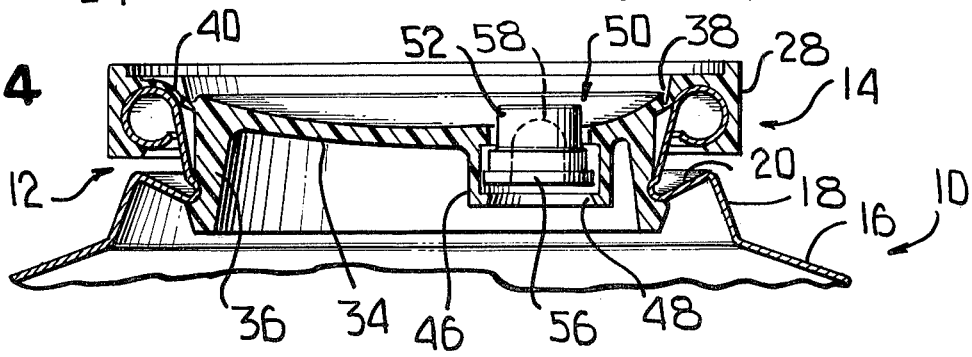
FIG. 4 is another fragmentary sectional view similar to FIG. 3, but showing the vent valve in an open or venting position.
Figure 5:
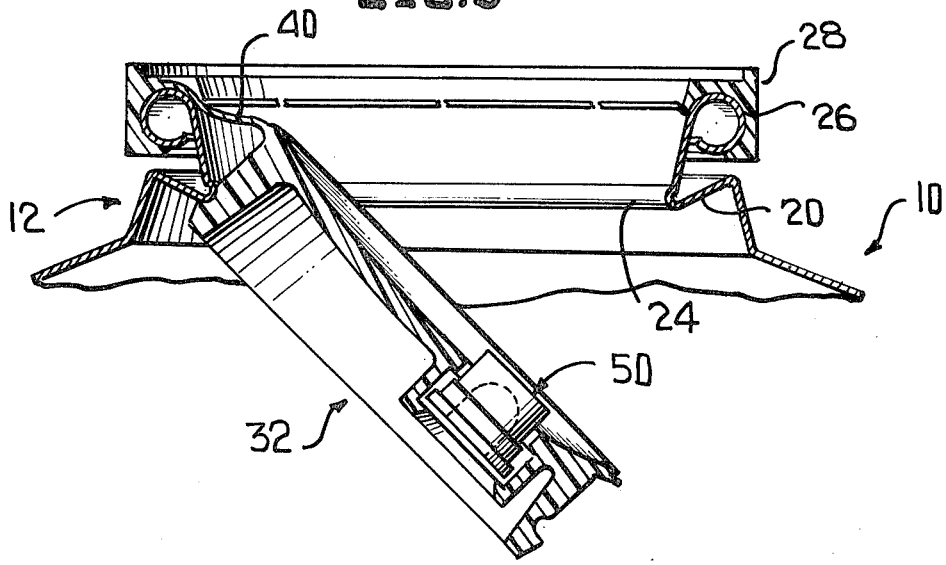
FIG. 5 is a further fragmentary vertical sectional view similar to FIG. 3, and shows the sealing plug portion of the closure pressed inwardly to an open or dispensing position.
Figure 6:
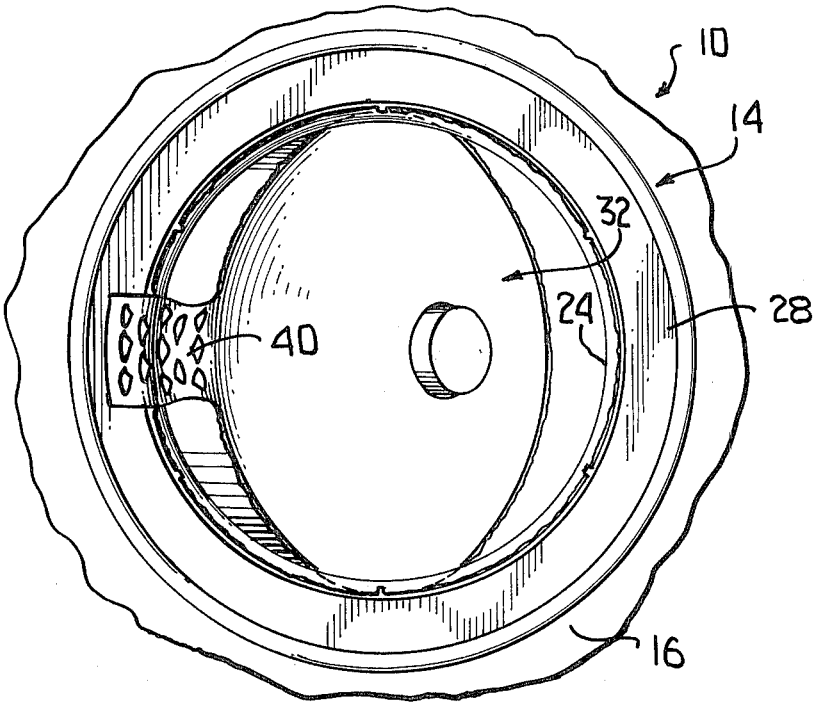
FIG. 6 is a top plan view of the opened container of FIG. 5.

In the operation of the closure 14, opening is effected by pushing down on the vent valve 50, moving it radially inwardly into the interior of the container to the extent permitted by the housing 46, as shown in FIG. 4. This results in the venting of pressures from within the container 10. Continued pressure on the vent valve 50 will apply pressure to the end panel 34 and effect rupture thereof along the weakining area 38. Once this rupture occurs, the sealing plug portion 32 may be snapped out of engagement with the locking shoulder 20 and the reversely turned portion 24 with the part of the depending skirt portion 36 underlying the hinge strap 40 pivoting on the revesely turned portion 24 and the sealing plug portion 32 pivoting to an open position within the container as shown in FIGS. 5 and 6. It will be seen that the sealing plug portion 32 remains attached to the retaining ring 28 by way of the hinge strap 40 with the hinge strap 40 being placed in tension by the pivoting action and becoming elongated.

It is to be particularly noted that the diameterof the end of panel 34, particularly that part which extends radially outwardly of the skirt 36, is of a greater diameter than the diameter of the pour opening defined by the revesely turned portion 24, and thus there is a wedging of the sealing plug portion 32 within the pour opening so as to retain the sealing plug portion 32 in the position to which it is depressed.

Once the sealing plug portion 32 has been ruptured relative to the remainder of the closure 14 and pressed inwardly into the container 10 to the position shown in FIGS. 5 and 6, the product packaged within the container 10 may then be readily poured therefrom.

Although the closure 14 is primarily intended to be utilized in conjunction with products which are packaged under pressurized conditions, it is to be understood that the closure could be utilized in conjunction with the packaging of liquids at atmospheric pressures. In such event, consideration may be given to the elimination of the vent opening 42 and the vent valve 50.

Although only a preferred embodiment of the closure has been specifically illustrated and described herein, it is to be understood that minor variations may be made in the closure without departing from the spirit and scope of the invention as defined by the appended claims.

We claim:

1. A closure for a container pour opening, said closure comprising an outer annular retaining ring portion and an inner sealing plug portion, said inner and outer portions being integral and joined together along the periphery of said inner portion, said inner portion being defined partly by a hinge and the remainder by a rupturable weakening line, whereby the closure may be opened by pressing in said inner portion.

2. A closure according to claim 1 wherein said closure is particularly adapted to be used in the packaging of a product under pressure, said inner portion having a vent opening therethrough for selectively relieving internal pressure and a plug valve normally closing said vent opening.

3. A closure according to claim 2 wherein said vent opening is disposed remote from said hinge.

4. A closure according to claim 2 wherein said vent opening is disposed remote from said hinge and in alignment with said hinge.

5. A closure according to claim 2 wherein said plug valve includes a piston open to the underside of said inner portion wherein said plug valve is constantly urged to an upwardly projecting closed position by pressure on the underside of said closure.

6. A closure according to claim 1 wherein said outer portion has a locking groove formed on the underside thereof, and said inner portion has an upwardly facing peripheral locking shoulder.

7. A closure according to claim 1 wherein said outer portion has a locking groove formed on the underside thereof, and said inner portion has an upwardly facing peripheral sealing and locking shoulder.

8. A closure according to claim 1 wherein said hinge is in the form of a strap having elongation properties.

9. A closure according to claim 1 wherein said hinge is in the form of a strap having elongation properties of a mechanically induced type.

10. A closure according to claim 1 wherein said hinge is in the form of a strap having elongation properties of a mechanically induced type including transverse weakening lines.

11. A closure according to claim 8 wherein said strap extends into said retaining ring portion to effect an elongation thereof.

12. A closure according to claim 1 together with a container neck finish, said neck finish including an inner shoulder and said sealing plug portion having an axially inner part releasably locked behind said shoulder, said shoulder defining a pour opening of a selected diameter, and said sealing plug portion having an axially outer part of a larger diameter than said pour opening wherein when said sealing plug portion is pushed through said pour opening in the opening of said container said sealing plug portion is wedgingly retained in a tilted open position.

13. A closure and container according to claim 12 wherein said shoulder defines a fulcrum for said sealing plug portion adjacent said hinge, and said hinge is in the form of a strap having elongation properties.

14. A closure and container according to claim 13 wherein said elongation is of a mechanically induced type.

15. A closure and container according to claim 13 wherein said elongation is of a mechanically induced type including transverse weakening lines.

* * * * *